US006685228B2

(12) United States Patent
Riley

(10) Patent No.: US 6,685,228 B2
(45) Date of Patent: Feb. 3, 2004

(54) SELF-LAMINATING STRIP LABEL AND METHOD FOR ASSEMBLING SAME

(75) Inventor: James M. Riley, St. Louis, MO (US)

(73) Assignee: Laser Band, LLC, St. Louis, MO (US)

( * ) Notice: Subject to any disclaimer, the term of this patent is extended or adjusted under 35 U.S.C. 154(b) by 0 days.

(21) Appl. No.: 09/897,759

(22) Filed: Jun. 29, 2001

(65) Prior Publication Data

US 2003/0001381 A1 Jan. 2, 2003

(51) Int. Cl.[7] ..... B42D 15/00

(52) U.S. Cl. ..... 283/109; 283/87; 283/101; 428/42.3; 428/43

(58) Field of Search ..... 283/62, 81, 94, 283/101, 105, 109; 428/40.1, 41.7, 42.2, 42.3, 43

(56) References Cited

U.S. PATENT DOCUMENTS

| | | | |
|---|---|---|---|
| 3,197,899 | A | 8/1965 | Twentier |
| 4,627,994 | A | 12/1986 | Welsch |

(List continued on next page.)

FOREIGN PATENT DOCUMENTS

| | | |
|---|---|---|
| GB | 2 045 718 | 11/1980 |
| WO | WO 96/12618 | 5/1996 |

OTHER PUBLICATIONS

Avery Dennison DuraCard™.

Avery® Laminated Identification Cards #5361.

Sample of Standard Register Labels.

Brochure entitled: "Color Bar®—Click Strip™ Labeling System," Smead Manufacturing Company, date: unknown (Form No. SSS–CS–00).

Brochure entitled: "Integrated Document Management System," Smead Manufacturing Company, date: unknown (Form No. SLI–95).

Brochure entitled: "Color–Bar® Folders" by Smead Manufacturing Company, date: unknown.

Catalog entitled: "Reseller Catalog Number One" by Smead Software Solutions, date: unknown (Form No. SSS–RC1–00).

*Primary Examiner*—Monica Carter
(74) *Attorney, Agent, or Firm*—Thompson Coburn, LLP

(57) ABSTRACT

A self-laminating strip label is provided in a business form comprised of a face stock layer joined through a patterned adhesive/release coating layer to a laminating layer wherein separation lines are provided in each of the two layers with the separation lines being substantially aligned with the strip label being positioned above the laminating strip. A novel method is also taught for first separating the strip label from the form, inverting it, and reapplying it to the laminating strip to thus form a matrix within the form with adhesive securing the strip label to the laminating strip. The matrix may then be separated by separating the laminating strip along its defining separation line yielding a self-laminated strip label for application to a marker tab of a file folder or the like. In a second embodiment, the face stock of the two-layer business form includes a first somewhat larger separation line defining a dummy layer and a second separation line defining a somewhat smaller strip label, with the separation lines being appropriately aligned on the face stock with a fold line therebetween such that upon removal of the dummy label, a layer of adhesive is exposed to which the strip label may be adhered upon folding of the form in half. In a third embodiment, a strip label is offset from the lamination so that the form may be folded to bring the lamination layer into register and adhesive contact with the strip label for reliably aligning the two either prior to or after the strip label is adhered to another form.

50 Claims, 8 Drawing Sheets

U.S. PATENT DOCUMENTS

| | | | | | |
|---|---|---|---|---|---|
| 4,682,431 | A | | 7/1987 | Kowalchuk | |
| 4,696,843 | A | | 9/1987 | Schmidt | |
| 4,854,610 | A | * | 8/1989 | Kwiatek | 156/234 |
| 4,956,931 | A | | 9/1990 | Selke | |
| RE33,616 | E | | 6/1991 | Welsch | |
| 5,026,084 | A | | 6/1991 | Pasfield | |
| 5,045,426 | A | | 9/1991 | Maierson et al. | |
| 5,135,789 | A | | 8/1992 | Schmidt | |
| 5,227,004 | A | * | 7/1993 | Belger | 156/552 |
| 5,318,326 | A | | 6/1994 | Garrison | |
| 5,370,420 | A | | 12/1994 | Khatib et al. | |
| 5,383,686 | A | | 1/1995 | Laurash | |
| 5,418,026 | A | | 5/1995 | Dronzek, Jr. et al. | |
| 5,427,416 | A | | 6/1995 | Birch | |
| 5,486,021 | A | | 1/1996 | Laurash | |
| 5,486,436 | A | | 1/1996 | Lakes | |
| 5,509,693 | A | | 4/1996 | Kohls | |
| 5,509,694 | A | | 4/1996 | Laurash et al. | |
| 5,518,787 | A | | 5/1996 | Konkol | |
| 5,524,934 | A | | 6/1996 | Schwan et al. | |
| 5,547,227 | A | | 8/1996 | Laurash et al. | |
| 5,586,788 | A | | 12/1996 | Laurash | |
| 5,595,404 | A | | 1/1997 | Skees | |
| 5,598,970 | A | | 2/1997 | Mudry et al. | |
| 5,601,313 | A | | 2/1997 | Konkol et al. | |
| 5,630,627 | A | * | 5/1997 | Stewart | 283/105 |
| 5,637,369 | A | * | 6/1997 | Stewart | 283/81 |
| 5,648,143 | A | | 7/1997 | Mehta et al. | |
| 5,653,472 | A | | 8/1997 | Huddleston et al. | |
| 5,662,976 | A | | 9/1997 | Popat et al. | |
| 5,687,903 | A | | 11/1997 | Akridge et al. | |
| 5,933,993 | A | | 8/1999 | Riley | |
| 6,000,160 | A | | 12/1999 | Riley | |
| 6,016,618 | A | | 1/2000 | Attia et al. | |
| 6,053,535 | A | * | 4/2000 | Washburn et al. | 283/101 |
| 6,067,739 | A | | 5/2000 | Riley | |
| 6,071,585 | A | * | 6/2000 | Roth | 156/248 |
| 6,303,539 | B1 | * | 10/2001 | Kosarew | 427/150 |
| 6,331,018 | B1 | * | 12/2001 | Roth et al. | 283/56 |
| 6,361,078 | B1 | * | 3/2002 | Chess | 229/92.8 |
| 6,409,871 | B1 | * | 6/2002 | Washburn et al. | 156/256 |
| 6,438,881 | B1 | | 8/2002 | Riley | |
| 6,510,634 | B1 | | 1/2003 | Riley | |

* cited by examiner

SELF-LAMINATING STRIP LABEL AND METHOD FOR ASSEMBLING SAME

BACKGROUND OF THE INVENTION

It is well know in the art that labels are useful for many types of business forms. In many applications, it has been found that it is much more cost effective and convenient to provide essentially blank forms and then some form of separate customizable or printable label for uniquely identifying that form. One such major application for this technique includes the typical file folder with which those in office settings are imminently familiar. There are many different types of file folders including the ubiquitous manila file folders that have a tab which in the prior art provides a convenient place for the application of a label or even hand scrawling an identifying title for its contents. This tab has been located at the top or side of the file folder to accommodate the particular filing cabinet or shelf used to store what is typically a series of them each holding related information, such as patient files, customer files, etc. As an aid in maintaining them in proper order, avoiding losing or mis-filing files, and retrieving them, various schemes have been developed for all manner of coding systems. These include most predominantly color coding and bar coding.

One example of the type of labeling file folders which is available in the prior art is presently being marketed under the ColorBar®trademark by Smead Mfg. Co. That product essentially comprises self adhering labels provided in roll format or on a sheet which may be as large as 8½ by 11 inches and have multiple labels for convenient processing by a printer such as a laser printer, typically under computer control, with custom software also being provided. This product has become to be known as "strip labels" as they take the form of a strip which is approximately twice as wide as the tab and printable on both sides to allow the strip label to be adhered to and cover both sides of the tab. While this product, and other similar products, have allowed for the customized printing of labels that may then be applied to the various types of business forms including file folders, they have been further improved to solve issues that have developed with their use.

One such issue has been the unevenness with which these strip labels have been applied to the folders, thereby interfering with the "eyeballing" of a row of files to locate files that are out of place and otherwise making it difficult to locate a particular file due to the "inconsistent" appearance of the file labels. As it is desired for files to be kept neat and organized, an "inconsistent" appearance detracts from that goal. To solve this problem, there has been developed at least one method in the prior art for consistently aligning the labels as they are applied to the folder tab. That form and method is presently being marketed under the ClickStrip™ trademark by Smead Mfg. Co, and may be the subject of a pending patent application.

Still another issue which has arisen through the use of these types of labels is the propensity for the customized labeling to be worn away by the constant handling of the file by the strip label, which covers the file tab. As the tab sticks out from what is typically the side or top of the folder, it becomes a convenient "handle" for the user to grasp the file for removing it from, or replacing it back into, its location within the drawer or shelf. This usage induces an inordinate amount of wear on the pre-printed color bars or bar code or other identifying indicia as a person's fingers have contaminants such as perspiration, hand lotion, and other such substances which contact the face of the label and have a deleterious affect thereon. Furthermore, in some instances, the file may be difficult to remove or replace due to the crowding of the file folders so that some appreciable gripping force is applied, and the users fingers may slip, thereby "smearing" the label as the user attempts to move the file. Again, there has been at least one solution arrived at in the prior art which entails a separate sheet of lamination strips that are sized to cover the face, or one side, of the label strip after it has been printed and before it is removed from its backing sheet. Should the strip labels have been prepared a sheet at time, a sheet of laminating strips may also be applied to the sheet of strip labels in a single application. This technique allows for the application of laminating strips to a plurality of labels in one operation. The laminating strip may have an edge which extends beyond the edge of the strip label, assuming they are aligned properly as the laminating strip is applied to the strip label, with adhesive applied to the edge as an aid in applying the strip/lamination matrix to the file folder tab. However, that alignment issue is only addressed in the context of the aforementioned full sheet having the aforementioned full sheet having multiple strip labels and separate full sheet having multiple matching laminating strips. As can be appreciated, these separate sheets require extra material, at extra cost. As the lamination material would generally require a lamination carrier, and lamination material is relatively expensive, this solution does represent a significant additional expense. Furthermore, separate sheets of strip labels and laminating strips have to be handled by a staff person in order to assemble the strip labels, which takes time and effort. Unless proper care is taken, it is entirely possible and even likely that the laminating strips will not be properly aligned thereby detracting from the desired overall neatness of appearance, not even considering that improperly aligned laminating strips could result in premature peeling of the strip label/laminating strip from the file tab and thus failure of the strip label.

In order to solve these and other shortcomings of the prior art, and to reduce both material as well as labor cost, the inventor herein has succeeded in designing and developing several embodiments of a self-laminating strip label and a method of assembling the label and laminating strip and applying it to the file folder that virtually eliminates the possibility of incorrect alignment between them and which provides a finished strip label having a lamination applied on both sides.

In a first embodiment of his invention, the self-laminating strip label is assembled from a form having two layers. A first layer of a face stock material suitable for receiving a printed image overlies a second layer of a laminating material which is substantially transparent and which may be made from Mylar or other suitable material as is known in the art. These layers are adhered to each other with a pattern adhesive which allows for assembly of a strip label/laminating strip matrix, as will be explained. More particularly, the face stock has a separation line, which is preferably a die cut or perforation, which defines the strip label with the strip label being sized to fold over the tab and mark both sides of the tab, as known in the art. When the strip label is removed from the form, a layer of adhesive occupies a central portion of the label defined by a periphery where no adhesive is applied and instead a release coat insures that adhesive is left behind on the form as the label is separated therefrom. Thus, the strip label as separated from the form has adhesive at its central portion but not around its periphery which allows for handling of the strip label without a user's fingers contacting the adhesive. On the opposite side of the form, in the laminating layer, a second separation line or preferably die cut defines a laminating strip which is somewhat larger than the label, with the laminating strip and label being aligned with each other such that while contained within the form, the label is approximately centered over the laminating strip. Furthermore, as dictated by this construction and as will be further explained below, the laminating strip when separated from the form has a central portion which has no adhesive but which has an outer peripheral area surrounding its circumference whereat an adhesive layer is applied. To provide a strip label and laminating strip appropriately sized, an envelope-sized form may be used, or these label/laminating strip separation lines may be arranged in a plurality from top to bottom on an 8½×11 sheet. With this construction, a single form thus contains both the printable label as well as its laminating strip for covering it as it is applied to the file folder tab.

There are several methods available for using this first embodiment and applying it to the tab including one method which guarantees the self-alignment of the label with the laminating strip. As can be appreciated, the label may be removed from the form by separating the separation line which forms it. Thereafter, the label may simply be inverted and conveniently replaced back into the opening which it left behind. Thus, the form provides a convenient picture frame for receiving the label back into the form which is then self-aligned with the laminating strip on the opposite side of the form. As will be more specifically explained below, the adhesive applied to the laminating strip adheres it to the label as it is placed back in the form such that the two parts thus form an assembled matrix. The user then can conveniently separate the die cut formed in the laminating material layer and, as the label is adhered to the laminating strip, both are then conveniently removed from the form or carrier in one step. Should this method be followed, the user would then have in his hand an assembled matrix of a label and laminating strip which have been self-aligned with each other almost exactly as they had been formed at the factory, and the assembly/matrix is then ready for application to a file folder tab. The first embodiment of this invention, and the method for using it, are more fully explained below.

For convenience, the phrase "separating line" may be understood as either a die cut or perforation line, or other such impression made into the layer of material, and where "separating line" or the specific phrase "die cut" or "perforation" or "score" is used, one of ordinary skill in the art will understand that one or the other may be used as suits the particular application. In many instances, it would not significantly matter to the operability of the form should a "perf" line be used instead of a die cut, although for optimum results and convenience one or the other may well be preferred. Thus, the reader will understand that a separation line could be either, or some other similar line, with the specific preferred type of line being chosen by one of ordinary skill in the art using ordinary skills and teaching readily available to those of skill in the art, and that the subject invention should not be limited to either, unless specifically identified as being required in a particular location.

The inventor has also conceived of a second embodiment which includes a pair of die cuts cut into the face stock layer, with one of the die cuts being slightly larger than the other. These die cuts are arranged, and a perforation or fold line/score may be provided in the form such that as the larger (dummy) label is removed, the form may be folded over and the smaller label be nested within the opening. The slightly larger dimension of the dummy label allows for convenient placement of the smaller label into the opening without exact alignment therebetween. A laminating strip is defined by a cutout in the second layer of the form, as with the first embodiment, with this laminating strip being aligned with the dummy label die cut. With this embodiment, a user may perhaps more conveniently align the label with the laminating strip to form the label/laminating strip matrix prior to its application to the file folder tab. Furthermore, this embodiment may be constructed with alternating strips of release coating and adhesive which is a less complex adhesive/release coating pattern and which is anticipated to be easier to construct and perhaps less expensive.

The inventor has further developed still a third embodiment of the present invention. This third embodiment includes a strip label defined by a separation line in the face stock layer and a lamination defined by a separation line in the laminating material layer, with the strip label being offset from the lamination but with an edge of each lying in the same plane. Additional separation lines are provided in both layers, as explained more fully below, which allow for assembly of the strip label/lamination matrix in one of two inventive methods. In a first method, approximately half of the strip label is exposed and then adhered to the file folder tab, the lamination is exposed and folded over the strip label to which it is adhered, and then the rest of the strip label is exposed and adhered to the form. In a second method, the lamination may be first exposed and folded over to adhere to the strip label, the strip label then is exposed in steps as before and the strip label/lamination is adhered to the file folder. By constructing the form with the strip label and lamination edges adjacent, a simple folding over of the form reliably brings these two components into alignment so as to guarantee that the strip label/lamination assembly is properly created.

With each of the foregoing embodiments, the inventor has provided a two-layer form with separation lines and adhesive/release coating for creating a separate strip label and matching laminating strip which completely covers both sides of the strip label as it is applied to the file folder tab. Additionally, with either embodiment, the form conveniently allows for the creation of an assembly or matrix within the form which comprises the strip label and laminating strip aligned and adhered to each other prior to their removal from the form such that a user may "pre-assemble" the matrix in a reliably aligned fashion prior to applying the assembly/matrix to the file folder tab. Thus, should a user make a mistake, all that is wasted is a strip label form and not the file folder also. All this is achieved in a single, two layer form that may be readily processed by a printer, such as preferably a computer controlled laser or ink jet printer, or other such printers as are already known in the art. Furthermore, alignment markings or perforations may be applied to either embodiment as an aid in aligning the assembly/matrix with the file folder tab so that each assembly/matrix may be properly aligned with the file folder tab prior to its application. This insures that the laminated strip label is oriented properly with respect to each of the file folders in order to create a uniform and orderly filing system.

While the principal advantages and features of the invention have been briefly described above, a more detailed understanding of the invention may be attained by referring to the drawings and Detailed Description Of The Preferred Embodiment which follow.

DETAILED DESCRIPTION OF THE PREFERRED EMBODIMENT

Figure 1:
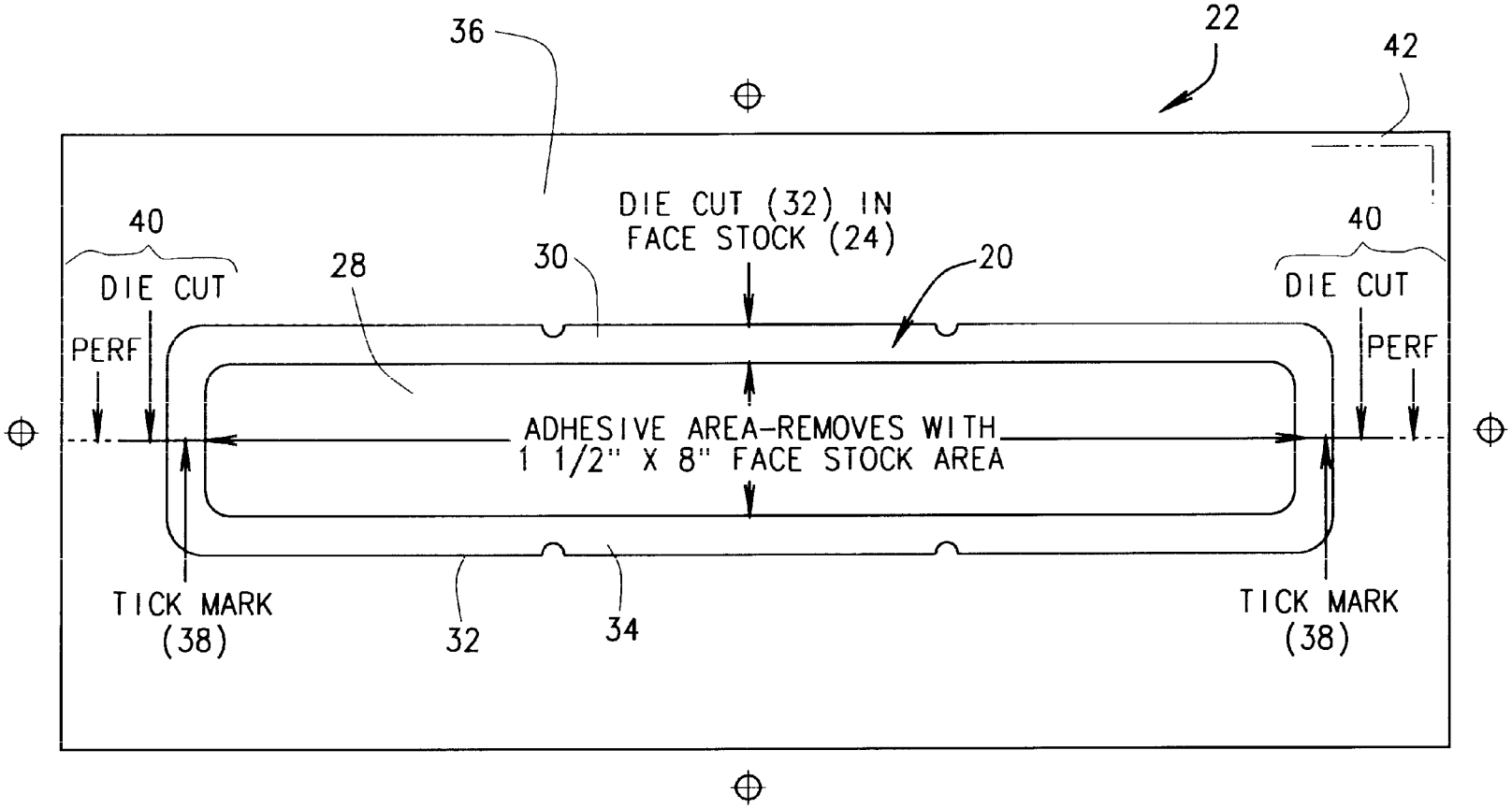
FIG. 1 is a top view of the envelope-sized form of the present invention detailing the die cut in the face stock layer for forming the strip label.
Figure 2:
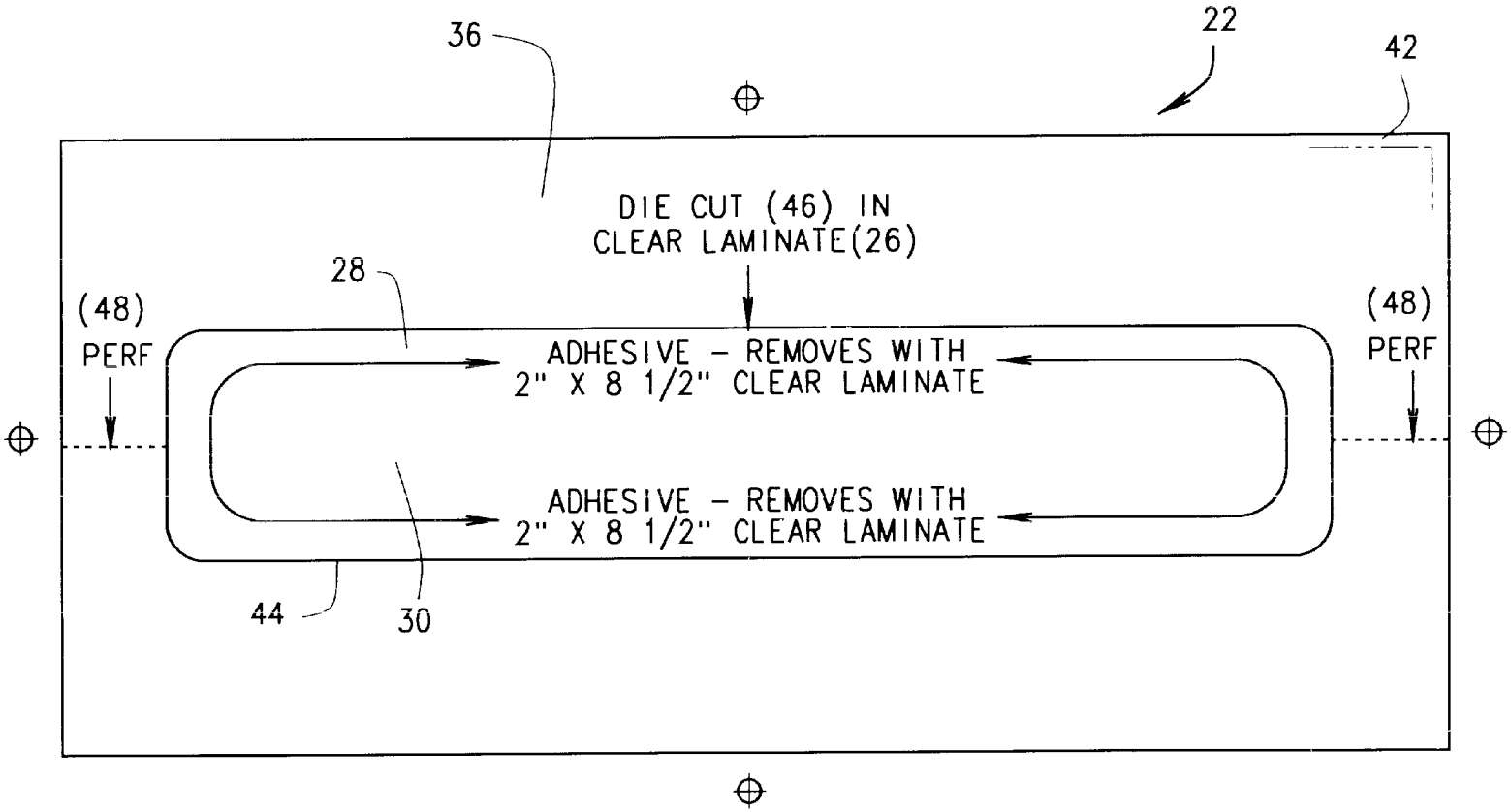
FIG. 2 is a bottom view of the envelope-sized form of the present invention detailing the die cut forming the laminating strip.

The first embodiment 20 of the self-laminating strip label of the present invention may be formed in a single enveloped-sized business form 22 as shown in FIGS. 1 and 2 which is itself comprised of a top layer of face stock 24 and a bottom layer of a laminating material 26 with a layer of patterned adhesive 28 therebetween. The face stock 24 may be any material that readily receives and retains a printed image which may be applied by any typical printer found in the prior art, such as preferably a laser printed under computer control. Face stock material may comprise bond, or other suitable types of paper layers as is known in the art. The laminate layer 26 may be formed from Mylar, other typical plastic materials, or other materials as would be well known in the art which would exhibit the qualities of a clear or transparent impervious to moisture and the like. The patterned adhesive 28 applied between layers 24, 26 would comprise any suitable adhesive material laid down in particular areas between the layers 24, 26 with a release coating 30 also applied in a particular pattern in order that adhesive would be retained on one of the two layers 24, 26 as desired to form the self-laminating strip label as is explained herein.

As shown in FIG. 1, the face stock 24 has a die cut 32 which forms a generally rectangular or oval-shaped strip label which is separable from the surrounding portion 36 of the face stock 24. In essence, the face stock 24 acts as a carrier from which the strip label 34 may readily be separated at its defining die cut 32. It is noted that in FIG. 1, the strip label 34 is actually depicted as being transparent so that the pattern adhesive 28 and release coating 30 are readily observable therein. Thus, in actuality, the pattern adhesive 28 and release coating 30 is not observable as the strip label 34 resides within the face stock 24. This depiction is considered to be an aid in understanding but should not be misunderstood by the reader to imply that the strip label 34 is not capable of holding an image printed on its upper surface. Preferably, tick marks 38 are formed at opposite ends of the strip label 34 and provide a helpful guide in aligning the strip label 34 or for folding the strip label 34 in half for application to a file folder tab. Additionally, perforation lines 40 extend from the edge of the form 22 and provide a ready means for separation of the strip label 34 from the face stock 24.

Referring more particularly to FIG. 2, the laminating strip 44 is formed and defined by a die cut 46 in the same generally oval or rectangular shape as the strip label 34 except that it is larger than each of the dimensions of width and height so that it might totally enclose strip label 34 and protect it during use. Another perforation 48 may extend from each edge of the form to the ends of laminating strip 44 as an aid in separating both layers on half of the form as an aid to affixing the assembled material to the file folder so it is aligned correctly.

As shown in FIGS. 1 and 2, the strip label may preferably be 1½"×8" of face stock while laminating strip 44 may be 2"×8½ of laminate material, the laminating strip thus being larger in each dimension as noted above. Of course, these dimensions are merely noted as being preferable with respect to existing file folder tabs and these dimensions may be adjusted as desired in order to provide self-laminating strip labels of virtually any dimension.

It is noted that the strip label 34 is substantially aligned to be directly above laminating strip 44, and the patterned adhesive 28 of strip label 34 is immediately above the release coat layer 30 of laminating strip 44, with release coating 30 of strip label 34 being substantially above a portion of the adhesive layer 28 of laminating strip 44 such that the form 22 when originally assembled may only include a single layer of patterned adhesive applied to it in order to satisfy the adhesive layering requirements for both strip label 34 and laminating strip 44. More particularly, it is noted that the adhesive layer 28 of strip label 34 is sufficiently large to enable it to be securely adhered to a file folder tab and that there is sufficient overlap between the adhesive layer 28 of laminating strip 44 and the face of label strip 34 to adhere the laminating strip 44 not only to it but also to the underlying file folder tab as the two are applied to the file folder tab.

One method for use of the first embodiment 22 of the present invention is to simply separate strip label 34 and apply it to a file folder tab, separate laminating strip 44 from the form, align it with the already applied strip label 34, and then adhere it to the strip label 34 and file folder tab in an overlapping arrangement. Preferably, strip label 34 is also aligned using tick marks 38 prior to its being adhered to the file folder tab.

Still another method for use of the first embodiment 22 of the present invention is to first separate strip label 34 from its surrounding carrier portion 36, invert it, and then reinsert it into the opening from whence it came. This process results in the assembly of the strip label 34 and laminating strip 44 into a matrix resident within the form 22. Furthermore, it is noted that this matrix is accurately aligned as between strip label 34 and laminating strip 44 due to the alignment of die cuts 32, 46 as this form is first manufactured. Thus, there is virtually no possibility for misalignment between the strip label 34 and laminating strip 44 which thereby insures that the strip label 34 will be fully protected and that both will have adhesive exposed for secure attachment to the file folder tab. After assembly of this matrix, the laminating strip 44 may be conveniently removed from the form which will also carry with it the strip label 34 as the two are adhered to each other with adhesive resident on laminating strip 44, as previously explained. The matrix is thus fully assembled, separated from its carrier, and ready for application to a file folder tab, with the matrix having been manufactured and presented for use in a single form and without the need to separately apply a laminating strip to a face stock strip label.

The assembled label/laminate matrix can also be aligned to the folder tab and affixed by first removing the "waste" face stock and laminate on half of the assembled form via the perforations, with the remaining "waste" on the other half of the form including "tick" marks or other markings, providing the user a guide to properly align the label to the file folder tab.

Figure 3:
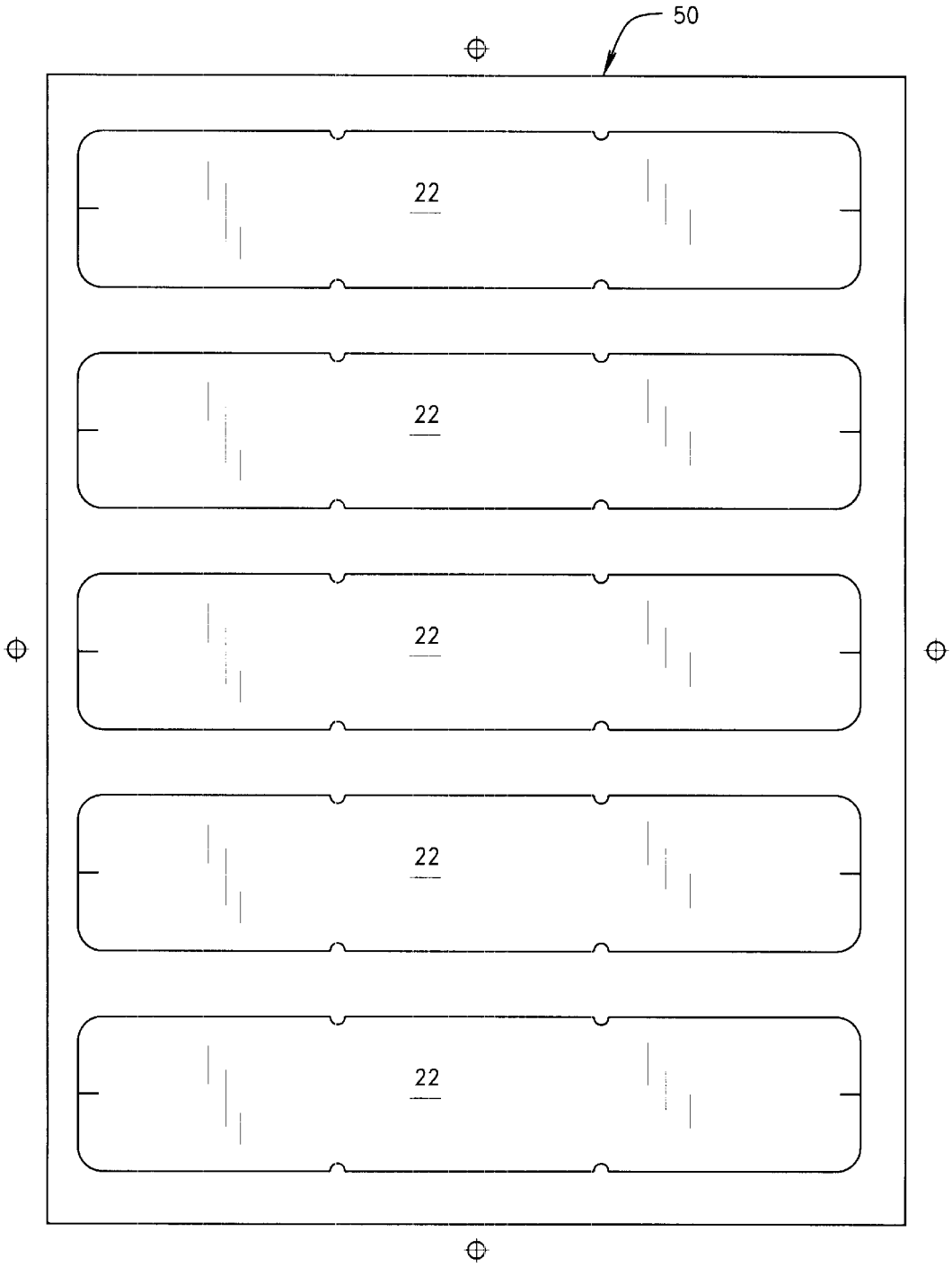
FIG. 3 is a top view of a sheet sized form having a plurality of self-laminating strip labels of the present invention.

Referring now to FIG. 3, it is noted that a single sheet 50, which is preferably an 8½×11 sheet, may contain a plurality of self-laminating strip labels 22 as exemplified by the construction shown in FIGS. 1 and 2 including the layering of patterned adhesive and release coating.

Figure 4:
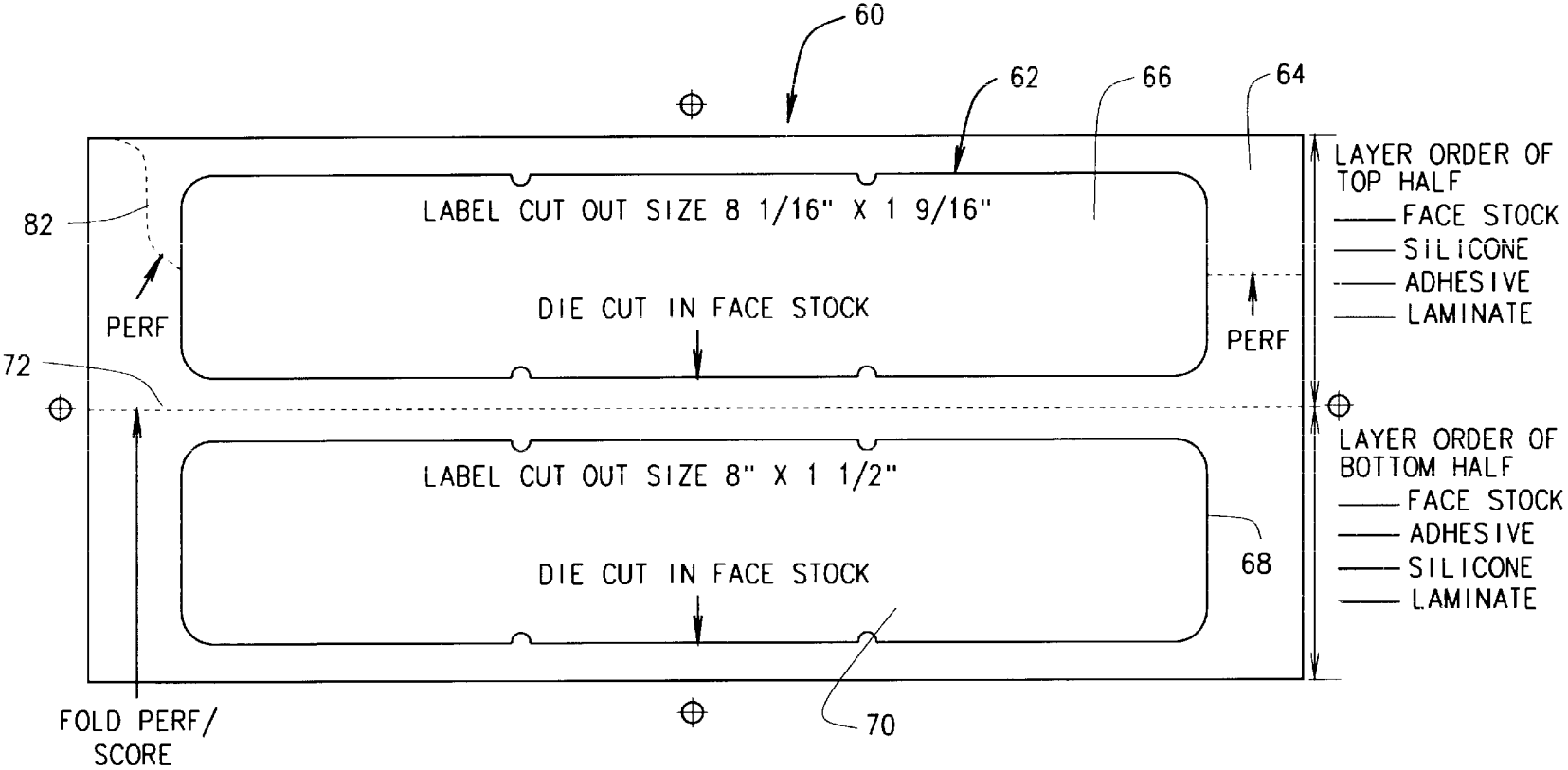
FIG. 4 is a top view of the second embodiment of the present invention detailing the die cuts for both the dummy label and strip label in the face stock layer.
Figure 5:
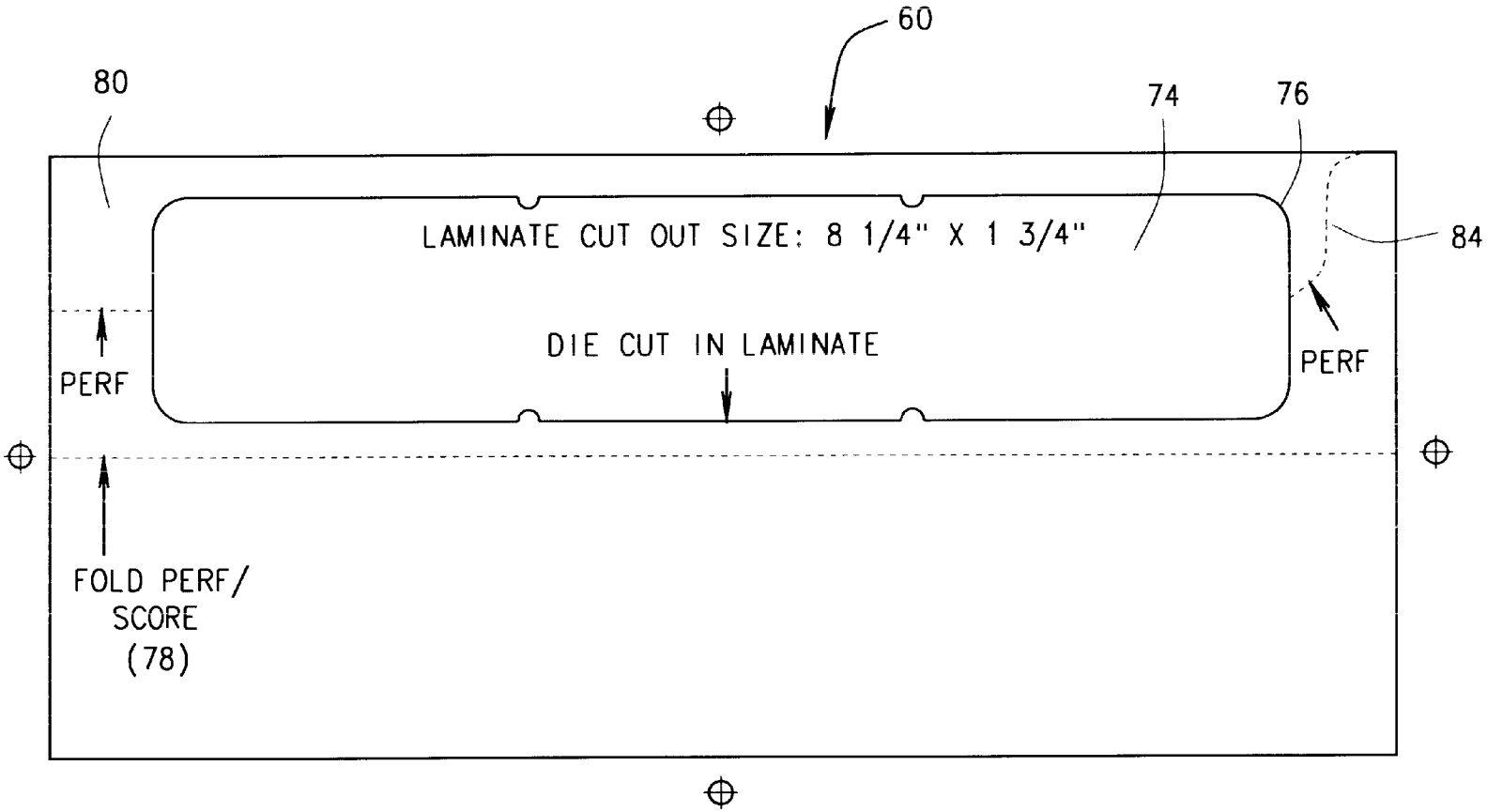
FIG. 5 is a bottom view of the second embodiment detailing the die cut in the lamination for forming the lamination strip.

A view of the top layer of face stock for the second embodiment 60 is shown in FIG. 4 and a view of the laminating layer is shown in FIG. 5. In this second embodiment 60, a first die cut 62 in the face stock layer 64 defines a dummy label 66 while a second die cut 68 defines the actual strip label 70, immediately beneath it. It is noted that dummy label 66 and strip label 70, and the respective die cuts 62, 68, are substantially aligned such that should the second embodiment form 60 be folded along a fold or perforated or score line 72, strip label 70 would fit within the opening formed upon removal of dummy label 66 from within its die cut 62. To facilitate this very action, it is noted that a preferable size for dummy label 66 is approximately 1/16" larger in each direction than the corresponding dimension for strip label 70 which is 8"×1½". Referring to FIG. 5, it is noted that a laminating strip 74 is defined by an associated die cut 76 above a fold or perforated or score line 78 which corresponds to the fold/perforated/score line 72 in the face stock layer 64. The laminating strip 74 is formed from a laminating material and is part of the laminating layer 80, as is similarly found in the first embodiment explained above. It is also noted that a preferred size of the laminating strip 74 is approximately ¼" larger in each dimension over the strip label 70 dimensions, and a corresponding 3/16" larger in each dimension over the dummy label 66 dimensions. With the construction of the second embodiment 60, a less complex patterned adhesive/release layer coating may be used than that of the first embodiment. Preferably, a layer of adhesive underlies the top half of the laminating layer 80 while a release coating underlies the top half of face stock layer 64. This is reversed for the lower half of the second embodiment 60 in that adhesive is applied to the bottom half of face stock layer 64 and a release coating applied to the bottom half of laminating strip layer 80. Thus, in essence, alternating strips of adhesive and release coating are applied to each of the layers 64, 80 as the layers are joined to form the second embodiment 60 as shown in FIGS. 4 and 5.

In use, a convenient method is provided for assembling the matrix comprising the strip label and laminating strip 74 through the following steps. First, the dummy label 66 is removed, thereby vacating an opening which is 1/16" larger in each dimension over the strip label 70. Removal of dummy label 66 (which is coated with a release coating so as to leave adhesive behind) exposes the adhesive coating applied to the back of laminating strip 74. The form may then be conveniently folded along fold line 72 which brings the upper surface of strip label 70 into contact with the adhesive now exposed on the back of laminating strip 74. Thus, strip label 70 becomes adhered to laminating strip 74 thereby rendering it relatively easy to separate the die cut 68 which separates strip label 70 from its surrounding carrier portion of face stock layer 64. The form is then conveniently unfolded and the matrix comprising the adhered strip label/laminating strip is formed within the second embodiment 60. This assembly or matrix may then be separated from the form and applied to a file folder tab using a perforation line 82 and perforation 84 to align the matrix with the file folder tab. The dummy label 66 may then be discarded as waste along with the carrier portions of the second embodiment 60.

In this second embodiment 60, it is noted that the additional spacing provided by the dummy label cutout offers more room for "play" as the matrix is assembled within the form. Thus, exact alignment between the strip label and the dummy label cutout is not required to successfully assemble the matrix. Furthermore, it is not considered that allowing for an exact placement between the strip label and laminating strip will detract from the eventual uniformity of the file folder with strip label applied. While 3/16" of extra space has been allotted in each of the two dimensions of the strip label, these are a matter of design choice and other dimensions may be utilized to achieve the purposes of the invention depending upon the particular application, materials chosen, etc.

Figure 6:
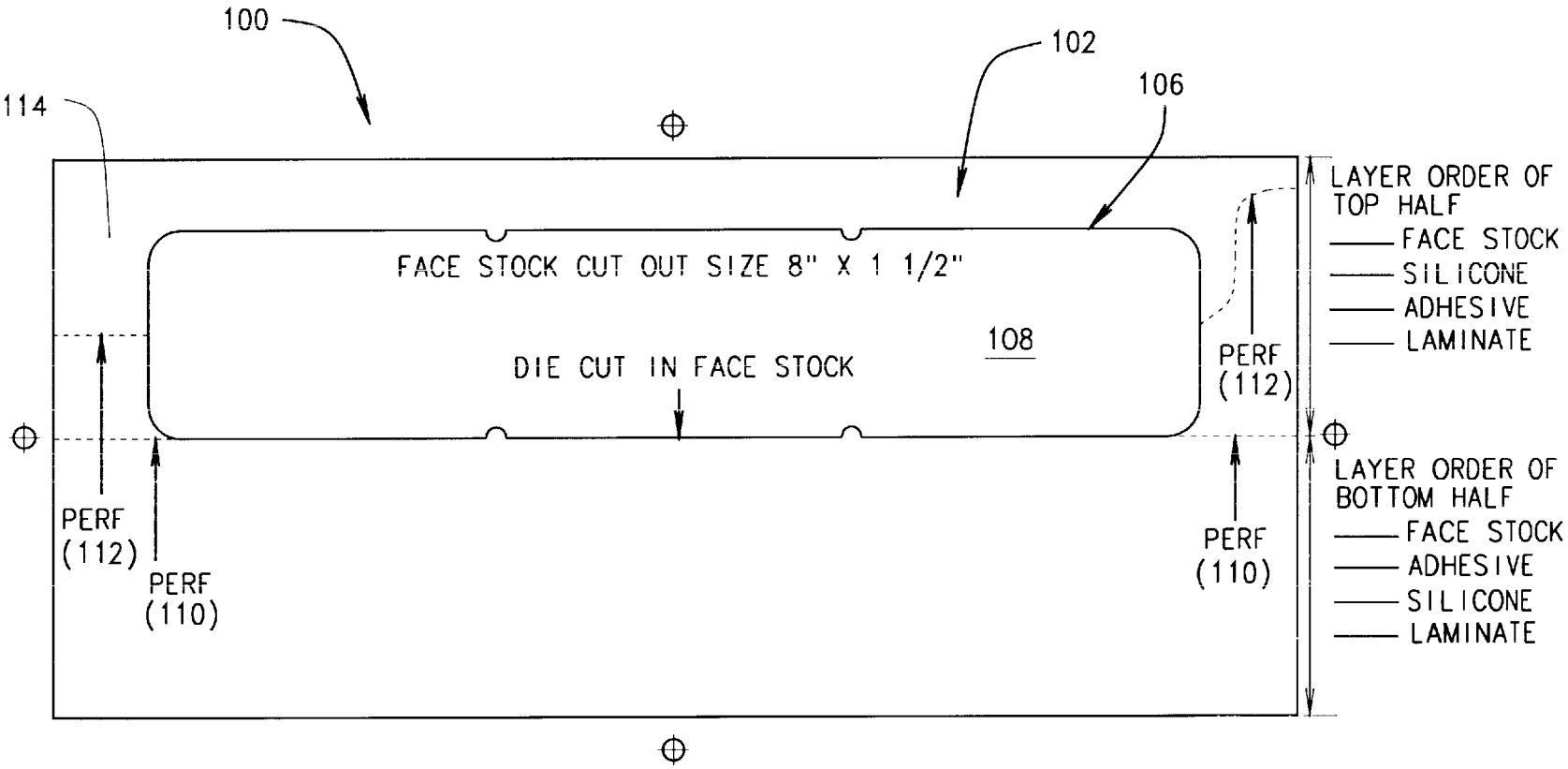
FIG. 6 is a top view of the third embodiment detailing the face stock layer and corresponding separation lines for forming the strip label.
Figure 7:
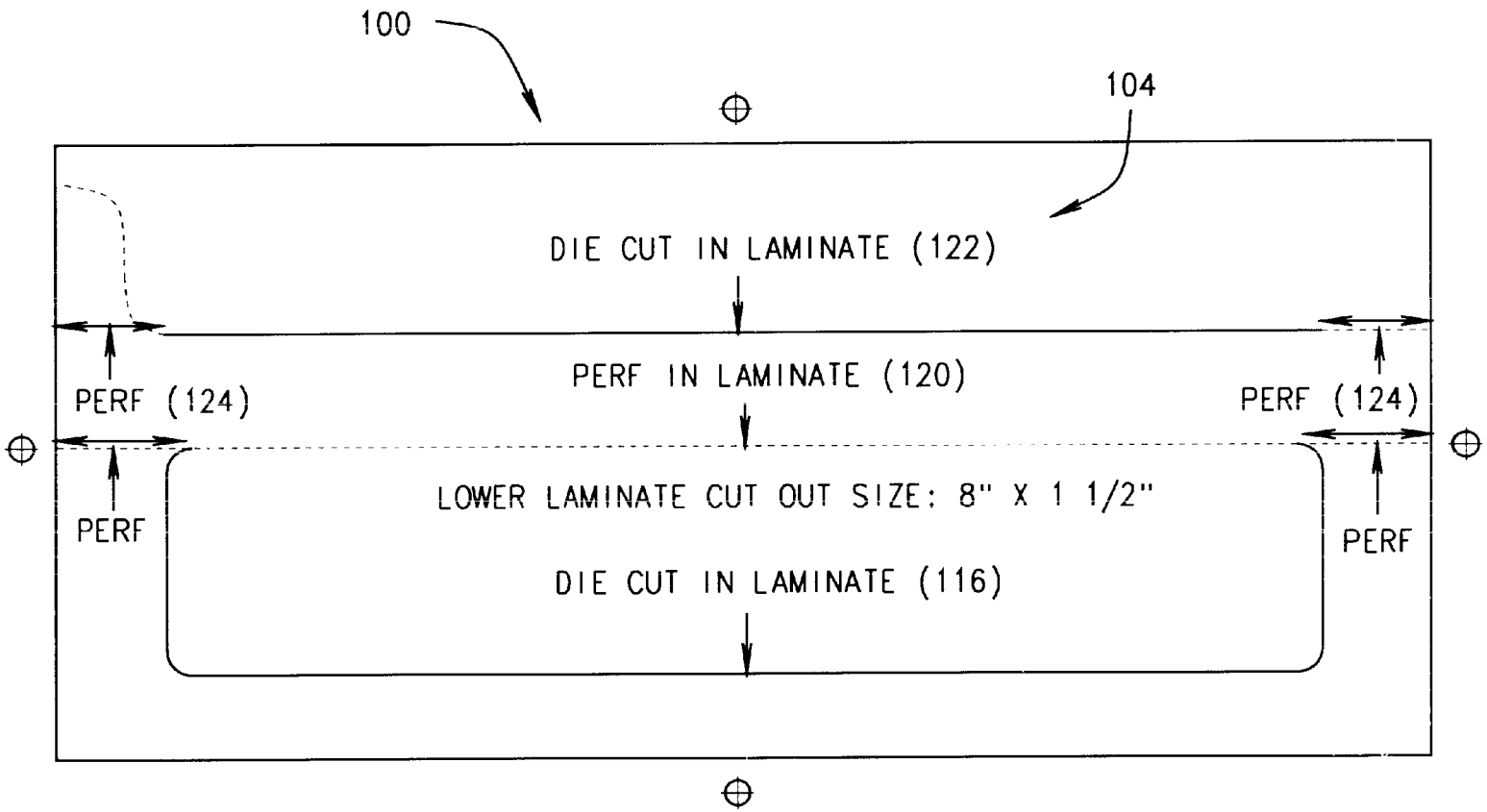
FIG. 7 is a bottom view of the third embodiment detailing the separation lines for forming the lamination.

The third embodiment 100 is shown in FIGS. 6 & 7 as the face stock layer 102 and the laminating material layer 104. Referring first to the face stock layer 102, a die cut 106 surrounds and defines the strip label 108, as before. However, a line of perforation 110 extends to the edge of the layer 102 along the bottom of the strip label 108 and provides a fold line, as will explained below. A second set of perforations 112 provide for separation of the surrounding carrier 114 adjacent the top half of the strip label 108 as will aid in applying the strip label 108 to the file folder tab, as explained below.

The laminating layer 104 also includes a die cut which surrounds three sides of the lamination 118, with the fourth side being completed with a perforation line 120. This perforation line 120 extends out to the edge of the laminating layer 104 and provides a fold line prior to separation of the lamination from the laminating layer 104 as explained below. Another die cut 122 has perforation line extensions 124 carried out to the edge of the laminating layer 104. Die cut 122 bisects strip label 108 such that separation of the laminating layer at die cut 122 and perf line extensions 124 along with separation along perf lines 112 and joining die cut 106 will expose the top half of strip label 108. Furthermore, the bottom of die cut 106 lies in substantially the same plane as the perf line 120, such that the form may be folded about perf line 120 to bring lamination 116 into register with strip label 108. With the bottom half of face stock layer 102 removed so as to expose lamination 116, folding over of the form about perf line 120 will cause lamination 116 to also adhere to strip label 108.

Generally, it is known in the art that carrying die cuts out to the edge of a form is not good practice as it could interfere with printer operation as the form feeds through it. Thus, the choice of perforations versus die cuts may be seen as design choice in many instances even though somewhat superior processing may be experienced by properly choosing which goes where.

As with the second embodiment 60, stripes of adhesive and release coating, such as silicone, are alternated between the top half and the bottom half of the third embodiment 100. In other words, for the top half of the form, a layer of adhesive is applied adjacent the face stock and a layer of release coating is applied adjacent the laminating layer. In the bottom half of the form the release coating is applied adjacent the face stock and the adhesive layer is applied adjacent the laminating layer. Thus, the "pattern adhesive"

devolves into striping. This is anticipated to decrease the cost of manufacture and also make the form easier to manufacture.

The third embodiment may be assembled in either of two inventive methods. In a first method, the top half of the strip label is exposed by separating both layers along the previously noted separation lines. The strip layer may then be adhered to the file folder tab, and aligned with the markings as noted. As only half of the strip label is exposed, a user may conveniently align it and adhere the exposed half. The lamination is then exposed and adhered over the top of the strip label. Preferably, in this embodiment, the strip label and lamination are substantially the same dimension so that they may overlie one another without overlap. Then, the rest of the strip label may then be exposed and adhered to the file folder with the carrier being discarded as waste.

As a second method for assembling the third embodiment, the lamination may first be exposed and adhered to the strip label by removing the bottom half of the face stock layer and folding the form about perf line 120. The user may then alternately follow the method described above for first exposing half of the strip label, aligning and adhering it to the file folder, and then exposing and adhering the rest. Or, the user may then peel off and expose the entire strip label and apply it "free hand" without the alignment markings found on the carrier portion of the form. Once the skill is acquired, a user may choose the second alternative as being probably faster than the first in assembling and applying the strip label.

Figure 8:
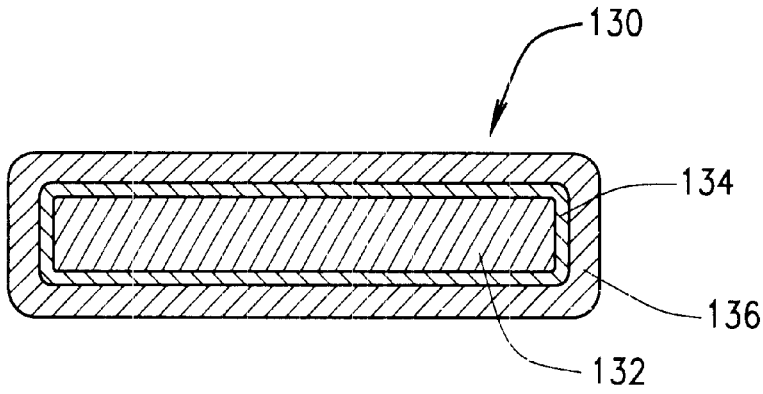
FIG. 8 is a bottom view of the matrix formed from the first embodiment.
Figure 9:
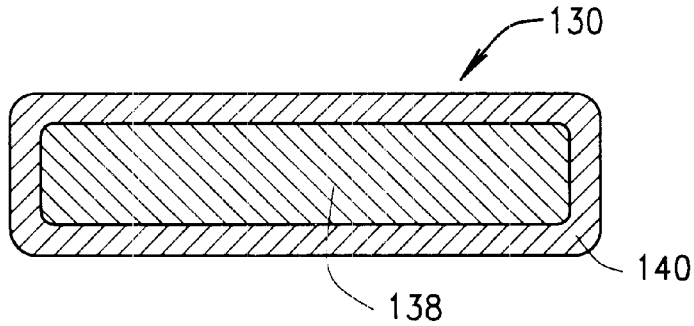
FIG. 9 is a bottom view of the matrix formed from the second embodiment.
Figure 10:
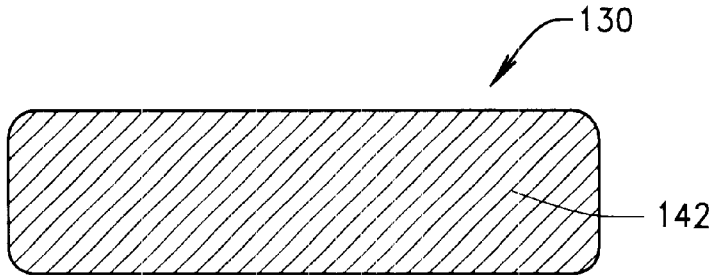
FIG. 10 is a bottom view of the matrix formed from the third embodiment.

The matrix 130 formed from each of the embodiments is shown in FIGS. 8 to 10, respectively. As shown in FIG. 8, there are three areas of adhesive with only two of them exposed to the other form. A first adhesive area 132 is resident on the strip label and acts to adhere the strip label to the other form. A second adhesive area 134 adheres the laminate to the strip label and is not exposed to the other form. Instead, an area of release coating is presented to the other form as the matrix is applied to it. A third area of adhesive 136 is resident on the laminate and acts to adhere the laminate to the other form. Thus, there is adhesive to adhere the strip label and laminate to each other and, separately, to the other form.

Referring now to FIG. 9, a first area of adhesive 138 is resident on the strip label and acts to adhere the strip label to the other form. Not shown, but underlying the first area, is a layer of adhesive which adheres the laminate to the strip label. A second area of adhesive 140 adheres the laminate to the other form. Thus, as with the first embodiment, there is adhesive to adhere the strip label and laminate to each other and, separately, to the other form.

Referring now to FIG. 10, a single area of adhesive 142 is resident on the strip label and acts to adhere the entire matrix to the other form. Not shown, but underlying the single area 142, is a layer of adhesive which adheres the laminate to the strip label. As the laminate and strip label are co-extensive in this embodiment, there is no separate area of adhesive which directly adheres the laminate to the other form.

Various changes and modifications may be made to the invention without departing from the spirit and scope of the invention as disclosed herein in the form of several preferred embodiments. Several of these changes and modifications have been suggested throughout the specification and others would be readily apparent to those having skill in the art upon reading and understanding the present disclosure. For example, the lines in the form that separate the various portions thereof may be referred to generically as separation lines. They may be chosen as die cuts, scores, perforations, etc. by selection for the particular position and usage. Those of ordinary skill in the art, using the present disclosure as a guide, would have no difficulty determining which of these would be most appropriate for the particular location of interest. Thus, the invention should not be considered as being limited to a particular kind of separation line unless specifically noted as being required. Therefore, the scope of the present invention should be limited solely by the scope of the claims appended hereto and their legal equivalents.

What is claimed is:

1. A business form, said business form comprising two layers of material, a first of said layers comprising a strip label layer and a second of said layers comprising a lamination layer, said strip label layer having an associated separation line therein defining a strip label so that said strip label layer may be separated along its associated separation line to form the strip label, and said lamination layer having an associated separation line therein defining a lamination so that said lamination layer may be separated along its associated separation line to form the lamination, wherein said layers comprising said business form are separated by a patterned adhesive layer, and wherein said strip label and lamination may be separated from the form and adhered with said same patterned adhesive layer to another business form with the lamination overlying the strip layer to protect the same.

2. The business form of claim 1 wherein the separation lines defining the strip label and the lamination are substantially aligned.

3. The business form of claim 2 wherein the strip label separation line is approximately centered on the lamination separation line.

4. The business form of claim 3 wherein the lamination is larger than the strip label so that as the two are adhered to said other form the lamination may be positioned to overlie substantially the entirety of the strip label.

5. The business form of claim 4 wherein the strip label is void of adhesive around a periphery of its inside surface.

6. The business form of claim 5 wherein the patterned adhesive layer includes adhesive around an inner circumference of the inside surface of said lamination which, when the strip label is aligned with and applied to the lamination, overlies the strip label around a periphery of its outside surface so as to adhere the strip label to the lamination.

7. The business form of claim 6 further comprising a plurality of said strip label and aligned lamination included therein.

8. The business form of claim 6 further comprising an alignment marking for aligning the strip label with an edge of a folder.

9. A self laminating strip label separable from a carrier, the carrier being comprised of two layers of material separated by a patterned adhesive layer, the first layer being comprised of face stock and the second layer being comprised of a substantially transparent protective material, each of said layers having a separation line therein defining a strip label and a lamination, respectively, with said separation lines being substantially aligned, and wherein said strip label and said lamination may be formed, respectively, by separation of said layers along their corresponding separation lines.

10. The business form of claim 9 wherein the lamination is larger than the strip label so that as the two are aligned and applied to another form the strip label is completely enclosed by the lamination.

11. The business form of claim 10 wherein the patterned adhesive includes adhesive around an inner circumference of the inside surface of said lamination which, when the strip label is aligned with and applied to the lamination, overlies the strip label around a periphery of its outside surface so as to adhere the strip label to the lamination.

12. The business form of claim 11 wherein the separation lines defining the strip label and the lamination are substantially aligned so that the strip label separation line is approximately centered on the lamination separation line.

13. The business form of claim 12 wherein the patterned adhesive layer does not adhere the strip label and the lamination as they form part of the carrier so that they are separately removable from the carrier.

14. A method of forming a laminated strip label from the carrier of claim 9, the method comprising the steps of:

separating the strip label from the carrier, applying the strip label to another form, separating the lamination from the carrier, and applying the lamination to the strip label and other form, with the lamination being substantially aligned with the strip label to substantially overlie the strip label.

15. The method of claim 14 wherein the step of applying the lamination to the strip layer and other form includes adhering the lamination to each of them.

16. A method of forming a laminated strip label from the carrier of claim 9 and applying it to another form, the method comprising the steps of:

separating the strip label from the carrier, inverting the strip label, re-inserting the inverted strip label back into the void in the carrier created by the separation of the strip label to thereby adhere the strip label to the lamination, separating the lamination/strip label assembly from the carrier, and applying the lamination/strip label assembly to another form.

17. The method of claim 16 wherein the step of applying the lamination/strip label assembly to another form includes aligning the lamination/strip label assembly to said other form.

18. A form containing a laminated strip label, the form comprising two sheets of material separated by a layer of adhesive, one of said sheets comprising a printable face stock and the other sheet comprising a laminating material, and said sheets having a separation line defining a strip label and a lamination, respectively, said layer of adhesive being arranged on said form in a manner such that when said strip label is removed from said form, a first portion of said adhesive layer is exposed on said strip label and a second portion of said adhesive layer is exposed on said lamination.

19. The form of claim 18 wherein the separation lines are substantially aligned with each other.

20. The form of claim 19 wherein said layer of adhesive is a layer of patterned adhesive so that portions of the strip label are covered with adhesive as the strip label is removed from the form and portions of the lamination are covered with adhesive as the lamination is removed from the form.

21. The form of claim 20 wherein at least part of the portion of the lamination which contacts the strip label as the two are aligned for being applied to another form is covered with adhesive to thereby adhere the lamination to the strip label.

22. The form of claim 21 wherein said form further comprises a plurality of said laminated strip label.

23. The form of claim 21 wherein said form is approximately envelope sized.

24. The form of claim 21 wherein said separation lines are aligned to be substantially centered on a common axis, one above the other.

25. A form suitable for processing through a printer to thereby create a printed, self adhering laminated strip label matrix comprises a first layer of a printable face stock and a second layer of a laminating material, and a separation line in each of said layers to form a strip label and a lamination, respectively, by separation of each of said layers along its corresponding separation line, said separation lines being substantially aligned and said layers being joined by a layer of patterned adhesive so that upon separation of at least the strip label from the form it may be aligned and adhered to the lamination to thereby create the matrix.

26. The form of claim 25 wherein the lamination is substantially larger than the strip label so that the matrix when formed includes a strip label which is substantially covered by the lamination.

27. The form of claim 26 wherein the matrix when formed includes adhesive exposed over portions of both of the strip label and the lamination for adhering to another form.

28. A form suitable for processing through a printer to thereby create a printed, self adhering laminated strip label comprises a first layer of a printable face stock and a second layer of a laminating material, and a separation line in each of said layers to form a strip label and a lamination, the first layer having a second separation line forming a dummy label, wherein the dummy label, strip label, and the lamination are aligned so that upon removal of the dummy label the form may be folded to bring the strip label into contact with the lamination.

29. The form of claim 28 wherein said dummy label is slightly larger than the strip label so that upon its removal from said form thereby creating a dummy label opening in said form, the strip label will conveniently fit into the dummy label opening.

30. The form of claim 29 wherein the lamination has a layer of adhesive so that the strip label will be adhered to the lamination to form an assembly and the assembly may then be removed from the form.

31. The form of claim 30 wherein the form further comprises a set of alignment markings to aid in applying the strip label to a file folder tab.

32. The form of claim 30 wherein the lamination has a layer of adhesive, the strip label has a layer of adhesive, and the dummy label has a layer of release coating.

33. The form of claim 32 wherein the dummy label and the lamination are substantially aligned on top of each other.

34. The form of claim 33 wherein the lamination is slightly larger than the strip label so that when the assembly is applied to a file folder tab both of the strip label and the lamination adhere thereto.

35. A method of forming a laminated strip label from the form of claim 28 and applying it to another form, the method comprising the steps of:

separating the dummy label from the form, folding the form to bring the strip label into contact with the exposed opening formed through removal of the dummy label, the lamination having a layer of adhesive so that the strip label adheres to the lamination to thereby form an assembly, separating the lamination/strip label assembly from the form, and applying the lamination/strip label assembly to another form.

36. The method of claim 35 wherein the step of applying the lamination/strip layer assembly to another form includes adhering the lamination to each of the strip label and the other form.

37. The method of claim 36 wherein the step of applying the lamination/strip label assembly to another form includes aligning the lamination/strip label assembly to said other form.

38. A form containing a laminated strip label adapted for affixing to another form, the form comprising two sheets of material, one of said sheets comprising a printable face stock and the other sheet comprising a laminating material, said sheets having a separation line defining a strip label and a lamination, respectively, the laminating sheet having a second separation line for partially exposing the strip label so that the strip label may be applied to the other form, the face stock sheet having a second separation line for fully exposing the lamination, and the laminating sheet having a third separation line about which the lamination may be folded to align with and cover the strip label.

39. The form of claim 38 wherein the laminating sheet has a fourth separation line for exposing the rest of the strip label for being adhered to the other form.

40. The form of claim 39 wherein the second separation line in the laminating sheet exposes approximately one half of the strip label.

41. The form of claim 40 wherein the strip label half exposed by the second separation line in the laminating sheet is the upper half.

42. A form containing a laminated strip label, the form comprising two sheets of material separated by a layer of adhesive, one of said sheets comprising a printable face stock and the other sheet comprising a laminating material, said sheets having a separation line defining a strip label and a lamination, respectively, wherein said lamination and strip label are arranged in their respective sheets so that the lamination may be folded over to overlie and become adhered to the strip label prior to one of said lamination and said strip label becoming separated from the form.

43. The form of claim 42 wherein the strip label is arranged to be offset from the lamination, with an edge of each lying substantially in the same plane.

44. The form of claim 43 wherein one of said separation lines provides an alignment guide for aligning the strip label with the other form.

45. A method of forming a laminated strip label from the form of claim 38 and applying it to another form, the method comprising the steps of:

exposing a portion of the strip label, adhering the exposed strip label portion to the other form, exposing the lamination, adhering the lamination to the strip label, exposing the rest of the strip label, and adhering the rest of the strip label to the other form.

46. The method of claim 45 wherein the step of adhering the lamination to the strip label includes the step of folding the form to bring the lamination into contact with the strip label.

47. The method of claim 46 wherein the step of exposing the strip label includes the step of exposing substantially half of the strip label as an aid in properly aligning the strip label with the other form.

48. A method of forming a laminated strip label from the form of claim 42 and applying it to another form, the method comprising the steps of:

exposing the lamination, folding the form over so as to adhere the lamination to the strip label, exposing the strip label, and adhering the strip label/lamination assembly to the other form.

49. The method of claim 48 wherein the step of exposing the strip label includes first exposing substantially half of the strip label and further comprising the step of aligning the strip label with the other form before adhering the strip label/lamination assembly to the other form.

50. The method of claim 49 further comprising the step of exposing the rest of the strip label and adhering it to the other form after the step of adhering the first exposed half of the strip label.

* * * * *